United States Patent [19]

Gospodar

[11] 3,959,183

[45] May 25, 1976

[54] METHOD OF MAKING CATALYTIC STRUCTURES FOR TREATING GASES

[75] Inventor: Reinhard Gospodar, Wolfsburg, Germany

[73] Assignee: Volkswagenwerk Aktiengesellschaft, Wolfsburg, Germany

[22] Filed: Dec. 20, 1972

[21] Appl. No.: 316,839

[30] Foreign Application Priority Data

Dec. 21, 1971 Germany ..... 2163536

[52] U.S. Cl. ..... 252/477 R; 23/288 FC

[51] Int. Cl.[2] ..... B01J 35/02

[58] Field of Search ..... 252/477 R; 423/213.2, 423/213.5, 213.7; 23/288 F, 288 FC

[56] References Cited

UNITED STATES PATENTS

| | | | |
|---|---|---|---|
| 3,071,449 | 1/1963 | Shustack | 423/213.5 |
| 3,166,895 | 1/1965 | Slayter et al. | 23/288 FC |
| 3,172,893 | 3/1965 | Ameen | 252/477 R |
| 3,362,783 | 1/1968 | Leak | 252/477 R |
| 3,701,823 | 10/1972 | Hardison | 423/213.2 |
| 3,799,796 | 3/1974 | Hunter | 252/477 R |
| 3,883,307 | 5/1975 | Kim | 252/477 R |

*Primary Examiner*—W. J. Shine
*Attorney, Agent, or Firm*—Brumbaugh, Graves, Donohue & Raymond

[57] ABSTRACT

A catalytic unit for treating gases, particularly exhaust gases of internal combustion engines, is formed by rigidly bonding together all or a peripheral portion of the particles of a mass of discrete, closely packed particles to form a bounded, unitary gas-porous structure. The particles are coated, either prior to or following bonding, with an active catalytic agent. In an embodiment of the invention especially adapted for internal combustion engine applications, the catalytic unit thus formed may advantageously be mounted within a housing by an elastic, heat-resistant member interposed between it and the housing.

10 Claims, 5 Drawing Figures

Fig.3
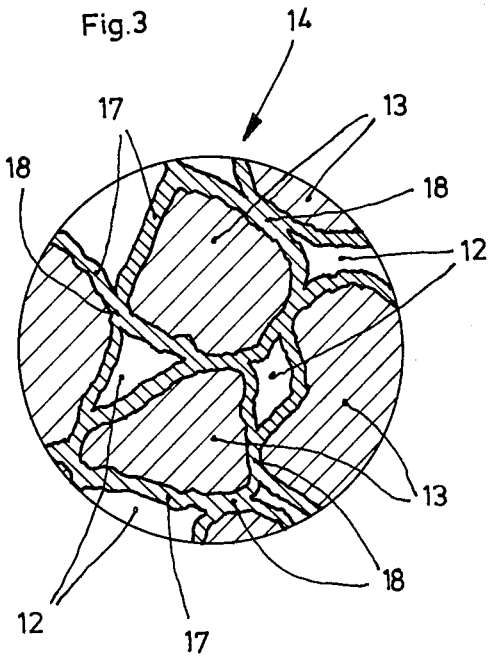
Fig.4
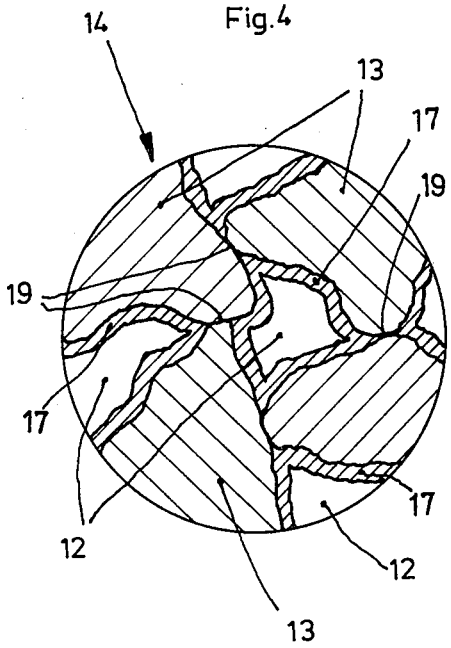
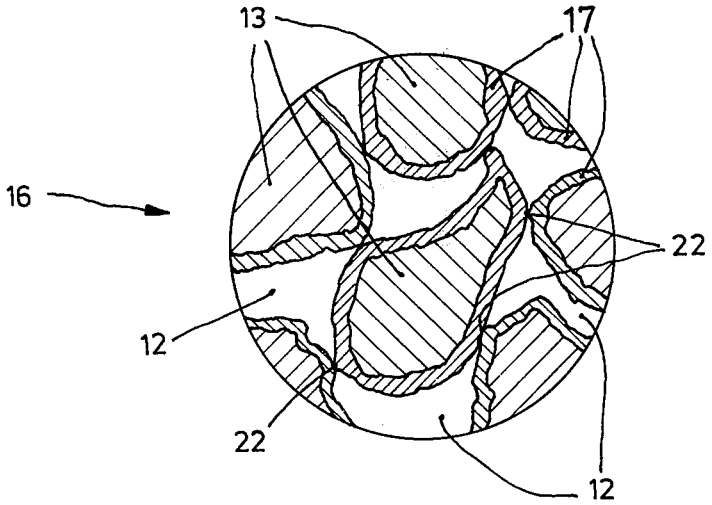
Fig.5

METHOD OF MAKING CATALYTIC STRUCTURES FOR TREATING GASES

BACKGROUND OF THE INVENTION

1. Field of the Invention

This invention relates in general to catalytic apparatus for treating gases and, in particular, to improved structures of this type, together with methods of manufacture thereof, which are especially adapted for use with exhaust gases of internal combustion engines.

2. The Prior Art

As is well known, the exhaust gases emitted by internal combustion engines include noxious components which are susceptible of being converted into harmless gas components by means of catalysis. Typically, this conversion is achieved by introducing appropriate catalysts into the exhaust system. Such catalysts are generally in the form of an active coating on a carrier material or member.

Catalysis on an active surface is a function of the extent of contact with the active surface of the gases to be converted. An increase in active surface area results in a corresponding increase in chemical conversion capacity. Thus, it is desirable in exhaust gas purification to provide a catalytic unit or structure that affords as large an active surface area as possible. For most efficient use of the catalyst, the ratio of active surface area to weight of the catalytic unit should be as high as possible. Furthermore, as the chemical conversion of noxious substances by way of catalysis generally occurs only at high temperatures, the catalyst selected, as well as the unit in which it is incorporated, must be sufficiently resistant to high temperatures. In applications involving motor vehicles, such catalytic units must in addition be capable of absorbing impacts without modification or destruction of their structure. Accordingly, the prerequisites of a suitable catalytic unit, especially if it is to be used with motor vehicles, are a large active surface and resistance both to high temperatures and physical shock.

Various forms of catalytic devices have been proposed in the past. One type includes a carrier structure comprised of a number of corrugated plates which are stacked in such a way as to leave free hollow spaces between them. An active catalyst is applied to the carrier plates as a coating and the exhaust gas to be purified is passed through the spaces between the corrugated plates. Catalytic converters of this type may be designated as monolith units inasmuch as the several coated, corrugated plates are combined to form a single package or structure. This package is enclosed in a housing which is provided with intake and outlet openings for passage of the exhaust gases. An elastic, heat-resistant separator is provided in surrounding relation to the catalytic structure to absorb dimensional changes thereof caused by temperature fluctuations, thereby assuring that the package is securely held within the housing during use.

As size is an important consideration, especially when the unit is to be used in a motor vehicle, known monolith catalytic devices must be provided with the thinnest possible carrier plates so that a maximum surface area may be obtained in a minimum volume. At the same time, the carrier material must have sufficient structural strength and heat resistance properties to withstand the thermal and shock loads attendant with motor vehicle usage. This necessitates the use of costly materials. Currently available materials, however, still do not possess the required structural characteristics. Consequently, catalytic units of the foregoing type remain susceptible to shock loads and, after only a comparatively short time of use, fissures appear in the corrugated plates. As the number of fissures increases, parts of the coated corrugated plates break off and drop to the plate below. The result is a dense caking of the catalytic agent and thus a reduction in the active surface area, with consequent loss of catalyst function. The useful lifetime of such monolith structures in motor vehicles, therefore, is quite short.

In another type of prior art device, the carrier material takes the form of free-flowing, discrete particles, with the active catalytic agent being provided as a coating on the particles. An enclosure having intake and outlet openings is filled with these coated particles. The particles are held in place by grates or screens to enable passage of the exhaust gases through the enclosure without loss of the catalyst. Since exhaust gases are emitted from an internal combustion engine in a pulsating manner, the loose, coated particles are caused to assume a to and fro movement within the enclosure. The individual particles, however, do not move with the same speed and frequency, so that the individual particles rub against one another. This frictional rubbing results in an abrading away of the active coating from the carrier particles. Continued removal of the active coating reduces the active surface area available for catalytic reaction, and thus produces a consequent decrease in the ability of the catalyst to function adequately. Hence, although catalytic units of the loose particulate type are otherwise generally satisfactory for motor vehicle use, this abrasion problem so seriously shortens their lifetime that they become inoperable after only a comparatively brief period.

These and other shortcomings of the prior art are overcome by the present invention.

SUMMARY OF THE INVENTION

It is accordingly an object of the invention to provide a gas-treatment catalytic unit which may be simply and inexpensively produced and which will remain fully operative over a prolonged period of time.

It is a further object of the invention to provide a catalytic unit having the foregoing characteristics which is particularly adapted for use with internal combustion engines and especially motor vehicles.

These objects, as well as other objects which will become apparent in the discussion that follows, are achieved according to the present invention by providing a catalytic structure comprised of a mass of discrete, closely packed particles, each coated with an active catalyst, at least peripherally located ones of which are rigidly bonded together at points on their surfaces to form a bounded, unitary gas-porous structure. The interiorly located particles may likewise be bonded together, so that all of the particles are rigidly interconnected, or, alternatively, they may be unbonded and contained in the manner of bulk fill firmly held within the shell formed by the bonded, peripherally-located particles. Preferably, the individual particles are sized to be within the range of from 1 to 20 cubic millimeters.

It is a feature of the invention that the above-described unitary, catalytic structure can be produced by extremely simple and economic techniques. For example, bonding of the particles to one another can be effected by first heat-softening their surfaces and then holding them in mutually contacting relation while the surfaces cool and adhere together. The cooling phase may be accompanied by compression of the particles to enhance adherence if desired. The latter technique is advantageously employed where larger sized particles are used. Bonding may also be carried out by cold pressing the particles together, or by applying a binding agent to the particle surfaces at the points of contact, or by sintering.

According to another feature of the invention, the active catalytic agent may be applied to the particles either prior to or after they are bonded together.

In an embodiment of the invention especially suited for use in motor vehicles, a catalytic unit constructed in accordance with the foregoing is mounted within a housing having a suitable gas inlet and gas outlet. An elastic, heat-resistant member or layer is interposed between the structure and the housing so as resiliently to support the structure and to accommodate thermally induced expansion and contraction thereof during use.

By virtue of the above features and construction, the invention affords the advantages of both types (monolith and loose particle) of prior art devices while avoiding their disadvantageous aspects. Thus it embodies at once both the high thermal and shock resistance and low production cost qualities and the favorable active surface area to weight ratio characteristics of the loose particle design, but without the life-shortening abrasion problem associated with that design. It likewise incorporates the secure, expansion-absorbing mounting features of the monolith unit, though not that design's susceptibility to thermal and shock loads and high production costs. It further eliminates the need for special handling and storage, and the atttendant increased costs, which are required with the monolith and loose particle units. The present invention, therefore, provides a catalytic structure having a long useful lifetime during which it can be utilized in full.

BRIEF DESCRIPTION OF THE DRAWINGS

For a better understanding of the invention, reference may be made to the following description of exemplary embodiments thereof, taken in conjunction with the accompanying drawings, in which:

FIGS. 3, 4 and 5 are expanded detail views of portions of the particle mass of FIG. 2, illustrating various forms of contact, bonded (FIGS. 3 and 4) and unbonded (FIG. 5), between the individual particles to provide a unitary, gas-porous structure.

DESCRIPTION OF EXEMPLARY EMBODIMENTS

Figure 1:
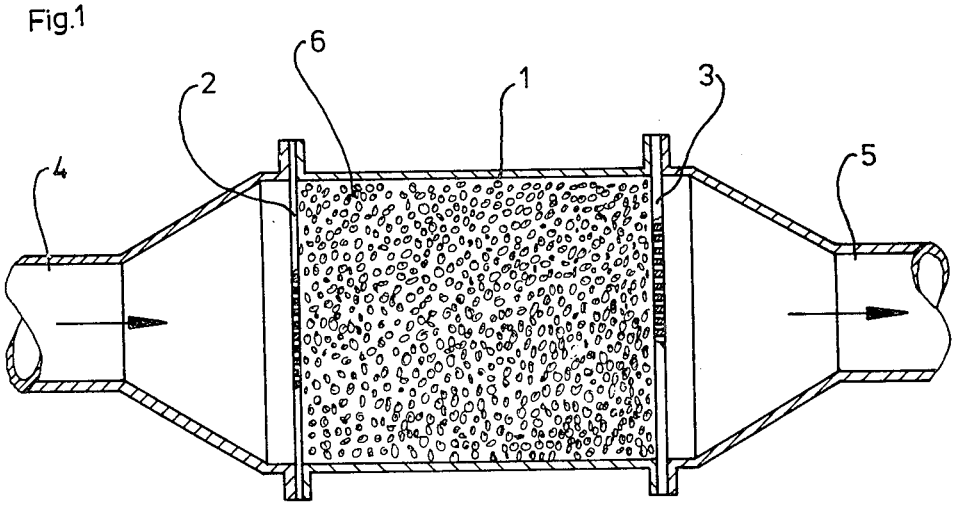
FIG. 1 is a longitudinal sectional view of a typical loose-particle prior art catalytic unit.

FIG. 1 illustrates a customary form of loose-particle catalytic converter unit, including a cylindrical housing 1 which is provided with a feed opening (not shown) for introduction of the catalyst-bearing particles 6. The housing 1 is closed off at the ends with grates or screens 2 and 3. A gas feed line 4 and a gas discharge line 5 are suitably fastened to the ends of the cylindrical housing 1 by flanges. These feed and discharge lines facilitate introduction of the unit into the gas system, e.g., the exhaust system of a motor vehicle. The feed and discharge lines 4 and 5 widen to the radius of the cylindrical housing 1. The housing is substantially filled with the coated particles 6 which, though not shown in FIG. 1 for purposes of clarity, are relatively closely packed together. The particles, however, are not bonded to one another.

Owing to the operational nature of internal combustion engines, the exhaust gas flow through the line 4 to the housing 1 pulsates. As a result of the pulsations, the particles 6 move to and fro resulting in an abrasive wearing off of the active coating. This removal of the active coating greatly shortens the effective operating life of the coated particles. Thermal expansion of the loose particles 6 is compensated for by an adequate air space within the area of the feed opening (not shown) or feeder funnel (not shown). This space contributes to the to and fro action of the particles, however, as it represents an unfilled space into which the particles may move under pressure of the gas flow.

FIGS. 2–5 depict illustrative embodiments of the present invention which, while retaining the beneficial features of the prior art design of FIG. 1, eliminate its shortcomings. Although the housing 7, feed line 8 and discharge line 9 are portrayed as having the same general configuration as those of FIG. 1, it will be understood that they may take any appropriate shape. In accordance with the invention, the interior of the housing 7 is filled in large part by a mass 10 of discrete, closely packed particles 13 at least a portion of which, as is described more fully hereinafter, are rigidly bonded together at points on their surfaces to form a bounded, unitary structure. The particles 13 may be of any suitable shape, e.g., spherical, cylindrical or irregular; and, as their surfaces bear on one another only at points (see, for example, FIG. 3), hollow spaces 12 are formed between the particles for permitting gas flow through the particle mass 10 in intimate, and extensive, contact with the active catalytic coating 17 of each particle.

Interposed between the particle mass 10 and the housing 1 is a heat-resistant elastic layer or member 11 which surrounds and supports the particle mass therein. Dimensional changes resulting from heating of the unitary particle structure are absorbed by the elastic layer 11. Thus, the elastic layer prevents damage to the particle structure while at the same time assuring a firm seating of the structure within the housing 7.

Figure 2:
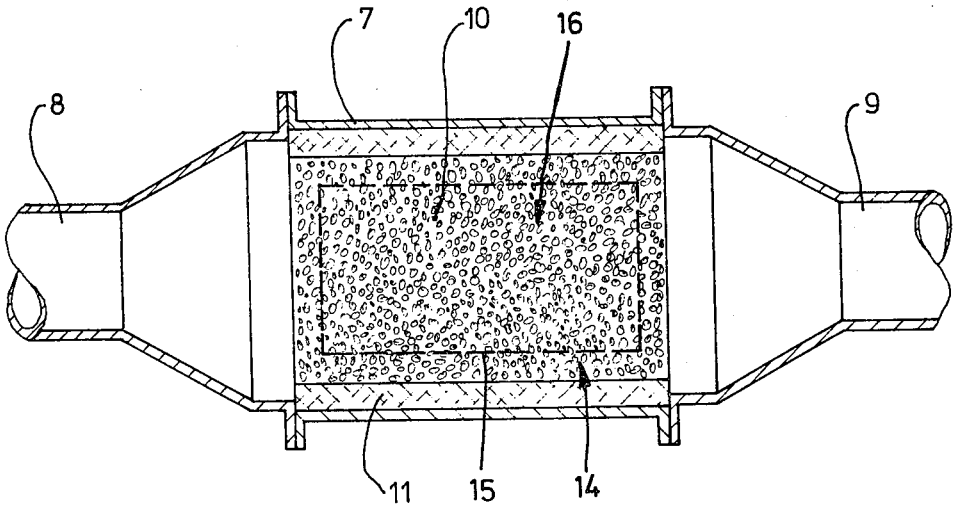
FIG. 2 is a longitudinal sectional view of an embodiment of the invention that is especially adapted for use in motor vehicles.

Either all or a portion of the particles 13 may be bonded together. With the first configuration, a substantially uniformly bonded structure is provided in which each particle is rigidly connected to an adjoining particle or particles. FIGS. 3 and 4 show illustrative forms of such rigid connections between the particles. According to the second configuration, however, only peripherally located particles, e.g., those within the edge zone 14 delimited by the dashed boundary 15 in FIG. 2, are actually bonded together in the manner of FIGS. 3 and 4. The interiorly located particles, e.g., those in zone 16, are present in the form of closely packed bulk fill, as illustrated in FIG. 5. Hence, the interior particles are everywhere tightly encased within the rigid shell formed by the outer, bonded particles. All of the particles are thus firmly held against abrading movement relative to one another, notwithstanding that the interior particles are unbonded. This has the added advantage of providing a porous structure of increased active surface area inasmuch as the points of contact 22 between the unbonded particles are considerably smaller than those between bonded particles (compare the points 22 of FIG. 5 with the larger regions of contact 18 and 19 in FIGS. 3 and 4, respectively), leaving more particle surface area available for catalysis.

It is a feature of the invention that the foregoing unitary gas-porous structure may be manufactured quite simply and economically. Thus, the particles to be bonded together, i.e., all of the particles or those in edge zone 14 only, may be rigidly connected by first heat-softening their surfaces and then allowing them to adhere to one another by holding them in mutually contacting relation as they cool. If desired, the particles may also be compressed during the cooling phase to enhance adherence. Preferably, moderate compression only is employed to avoid an undue reduction in active surface area. Another suitable technique is merely to cold press the particles together with sufficient force to effect bonding. Sintering also may be employed, with or without compression. Again, the particles may be bonded together by means of a binding agent applied to the particle surface.

The active catalytic agent may be coated on the particles either before or after bonding is carried out. Where initially uncoated particles are used, the coating may readily be accomplished, e.g., by spraying the active agent on the structure or by dipping the structure in a bath, after the outward, bounded shape of the porous, rigid structure is formed. Bonding followed by coating is preferred when relatively large size particles are used.

If the particles are relatively small in size, the active agent preferably is applied to the particles in advance of the bonding step. Of course, this technique could also be employed with larger particles if desired.

In line with the foregoing, FIG. 3 illustrates rigid connections between the particles 13 such as would be formed by first coating the particles with the catalytic agent 17 and then bonding them together by heat-softening their surfaces or by cold-pressing them together. Intimate bonds are thus established at regions of contact 18, with spaces 12 formed among the particles. FIG. 4, on the other hand, portrays the manner of connection where the particles 13 were rigidly bonded together at regions 19, as for example by sintering, prior to the application of the catalytic coating 17.

Ideally, the individual particles are within the range of from 1 to 20 cubic millimeters in size and may be composed of any suitable material, e.g., aluminum oxide or an appropriate composition of aluminum oxide, silicon oxide and magnesium oxide.

In a like manner, the heat-resistant layer 11 and the active catalytic agent may comprise any appropriate material. Various well-known materials are available for these purposes. For example, the heat-resistant layer 11 may take the form of an elastic wire cloth. If desired, an intermediate layer of a ceramic aluminum-silicate fibrous material may also be provided, with or without a wire reinforcement. Suitable catalytic agents may comprise noble metals of the platinum group, such as platinum, rhodium, paladium, iridium and combinations thereof, or non-noble metals, such as vanadium pentoxide, chromium oxide, copper, iron, cobalt and nickel.

Where a binding agent is employed in bonding the particles together, a heat-resistant inorganic adhesive is preferred. Suitable adhesives of this type include borax (sodium tetraborate) and water glass (aqueous solution of alkali silicates).

Although the invention has been described with reference to specific embodiments thereof, many modifications and variations of such embodiments may be made by those skilled in the art without departing from the inventive concepts disclosed. Accordingly, all such modifications and variations are intended to be included within the spirit and scope of the appended claims.

I claim:

1. A method of manufacturing a catalytic unit for treatment of gases passing through a flowpath, comprising the steps of:

forming discrete catalytic support particles into a unitary gas-porous structure of a cross-sectional size generally coextensive with that of the flowpath by closely packing said particles into a gas-porous mass and rigidly bonding together at points on the surfaces thereof at least those of said particles located adjacent the periphery of said mass of particles while maintaining the porosity of said mass; and prior to or after the bonding step, coating the particles with an active catalytic agent.

2. The method of claim 1 wherein the bonding step comprises:

heat-softening the surface of the particles to be bonded; and cooling the softened particles while holding them in surface-to-surface contact to bond the particles to one another.

3. The method of claim 2 wherein the bonding step further comprises applying compression to the softened particles during the cooling phase.

4. The method of claim 1 wherein the bonding step comprises cold-pressing the particles to be bonded into surface-to-surface contact with sufficient force to bond the particles together at the points of contact therebetween.

5. The method of claim 1 wherein the bonding step comprises:

applying a bonding agent to the surfaces of the particles to be bonded; and bringing the particles thus applied into surface-to-surface contact to bond the particles together at the points of contact therebetween.

6. The method of claim 1 wherein the bonding step is applied to all of the particles in the mass.

7. The method of claim 1 wherein the bonding step is applied only to peripherally located particles, and interiorly located particles are left substantially unbonded to one another.

8. The method of claim 1 wherein the individual particles are within the range of from 1 to 20 cubic millimeters in size.

9. The method of claim 1 wherein the coating step is carried out prior to the bonding step.

10. The method of claim 1 wherein the bonding step is carried out prior to the coating step.

* * * * *